United States Patent [19]

Niven

[11] 4,127,994

[45] Dec. 5, 1978

[54] OIL STIRRER FOR REFRIGERATION COMPRESSOR

[75] Inventor: Ralph E. Niven, Grove City, Ohio

[73] Assignee: White-Westinghouse Corporation, Pittsburgh, Pa.

[21] Appl. No.: 762,829

[22] Filed: Jan. 26, 1977

[51] Int. Cl.[2] ..... F25B 43/02; B04B 17/00; B04B 35/00; F04B 17/00

[52] U.S. Cl. ..... 62/469; 417/372; 417/902

[58] Field of Search ..... 62/468, 469, 508; 417/372, 902, 363; 239/223, 224, 221

[56] References Cited

U.S. PATENT DOCUMENTS

| | | | |
|---|---|---|---|
| 1,587,844 | 6/1926 | Landberg | 239/221 |
| 1,927,943 | 9/1933 | Long | 239/221 |
| 2,881,777 | 4/1959 | Panly | 239/221 |
| 2,930,522 | 3/1960 | Reichard | 417/372 |
| 3,133,429 | 5/1964 | Griffin | 417/372 |
| 3,147,914 | 9/1964 | Hatten et al. | 417/902 |
| 3,480,205 | 11/1969 | Hatten | 417/902 |
| 3,744,774 | 7/1973 | Huisman et al. | 239/224 |

*Primary Examiner*—Lloyd L. King
*Attorney, Agent, or Firm*—McNenny, Pearne, Gordon, Gail, Dickinson & Schiller

[57] ABSTRACT

A refrigeration motor-compressor assembly resiliently mounted within a hermetically sealed shell having a sump area containing lubricating oil continuously aerated by a stirrer fixed to a rotating shaft of the motor-compressor assembly is disclosed. The stirrer is formed of thin perforated sheet metal or screen mesh shaped into an open-ended truncated cone, the apex portion of which is fixed to the rotating shaft of the motor-compressor assembly while the base portion of the cone is submersed in the lubricating oil contained in the sump area. Aeration of the lubricating oil by the rotating stirrer attenuates the transmission of mechanical noise generated within the hermetically sealed shell.

7 Claims, 5 Drawing Figures

Fig. 1
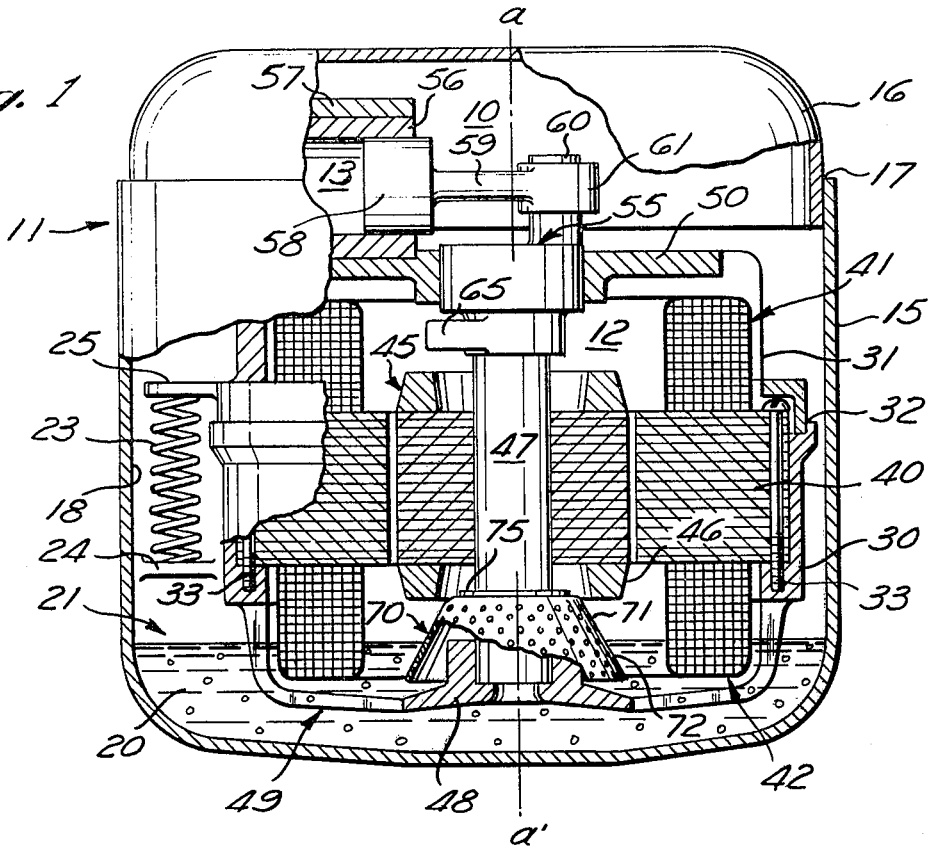
Fig. 2
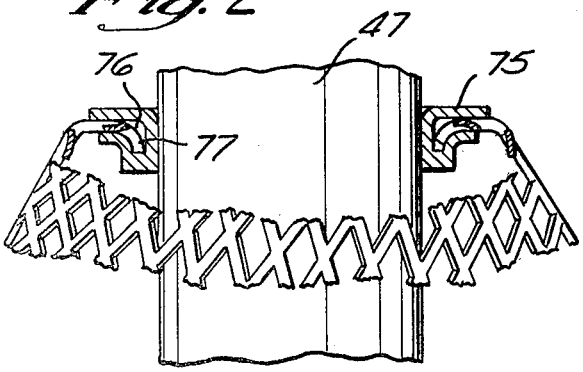
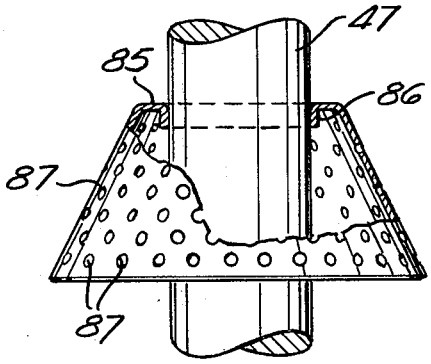
Fig. 4
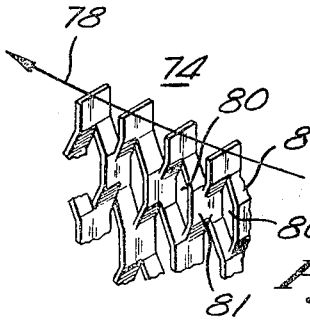
Fig. 3
Fig. 5
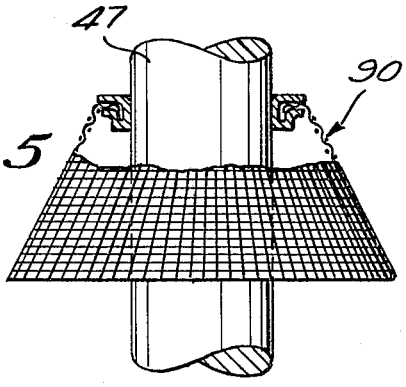

OIL STIRRER FOR REFRIGERATION COMPRESSOR

BACKGROUND OF THE INVENTION

The present invention is in the field of motor-compressor assemblies.

More particularly, the present invention relates to hermetically sealed refrigeration motor-compressor assemblies for use in domestic appliances such as refrigerators, freezers and room air conditioners.

It has long been recognized in the art that mechanical noise generated by the moving parts of an operating motor-compressor assembly within a hermetically sealed shell could be transmitted to the shell and hence to the surrounding environment. A portion of the noise was transmitted to the shell via the conventional body of lubricating oil contained in a sump area of the shell, the lower part of the motor-compressor assembly being submerged in the body of oil. This portion of noise transmitted to the environment surrounding the hermetically sealed shell is undesirable and means to reduce such noise are of prime importance especially in the field of domestic appliances.

It has been further recognized in the art that aeration of the body of lubricating oil so as to cause foaming lessens considerably the sound transmitting quality of the oil.

Various means have been proposed for aerating the lubricating oil located in the sump area of the hermetically sealed shell. U.S. Pat. Nos. 3,066,857, 3,147,914, 3,480,205 and 3,614,384, assigned to the assignee of the present invention, disclose various means for aerating the lubricating oil.

While suitable aeration of the lubricating oil may be accomplished by means such as disclosed in the heretofore noted patents, the process of aeration may generate undesirable noise. Thus the gain in overall reduction of noise due to the sound attenuating qualities of the aerated oil may be set off by the increased noise generated by the aeration process.

SUMMARY OF THE INVENTION

The present invention provides an oil stirrer for the improved aeration and foaming of lubricating oil contained in a sump area of a hermetically sealed refrigeration motor-compressor assembly. A portion of the stirrer comprises an apertured surface of revolution having its axis coincident to the longitudinal axis of rotation of a rotating shaft of the motor-compressor assembly.

A stirrer in accordance with the present invention can, at reduced noise levels, effectively aerate and foam the lubricating oil within the hermetically sealed shell.

The present invention may take the form of an open-ended truncated cone of perforated sheet metal having its apex portion fixed to the rotating shaft of the motor-compressor unit, while its base portion extends into the body of lubricating oil.

Aeration of the oil with refrigerant gas by rotation of the stirrer lessens the sound transmission qualities of the oil so that mechanical noise transmitted from the motor-compressor assembly via the oil to the shell is attenuated. The process of aeration is accomplished at reduced noise levels in accordance with the invention.

BRIEF DESCRIPTION OF THE DRAWINGS

FIG. 1 is an elevational view of a hermetically sealed motor-compressor assembly with portions cut away incorporating an oil stirrer constructed from perforated sheet metal in accordance with the present invention;

FIG. 2 is an elevational view of an alternative form of an oil stirrer with portions cut away constructed from foil-like expanded metal grid material (schematically illustrated) in accordance with the present invention;

FIG. 3 is a perspective view of a portion of the expanded metal grid material used to form the oil stirrer illustrated in FIG. 2;

FIG. 4 is an elevational view of another alternative form of an oil stirrer with portions cut away constructed from perforated sheet metal in accordance with the present invention; and FIG. 5 is an elevational view of another alternative form of an oil stirrer with portions cut away constructed from a screen mesh material in accordance with the present invention.

DESCRIPTION OF THE PREFERRED EMBODIMENT

Referring now to the drawing in greater detail, FIG. 1 discloses a refrigeration motor-compressor assembly 10 comprising an electric motor 12 and a piston-type compressor 13 contained within a hermetically sealed shell 11.

The hermetically sealed shell 11 has a lower section 15 and an upper section 16, the two shell sections being joined to each other at a hermetically sealed seam 17. The shell 11 contains a conventional refrigerant gas and a body of lubricating oil 20 located in a sump area 21 at the bottom of the lower section 15 of the shell 11.

The motor-compressor assembly 10 is resiliently mounted within the shell 11 by means of support springs 23 (one of which is illustrated) having their lower ends resting on and fixed to lugs 24 (one of which is illustrated) protruding inwardly from an inner wall 18 of the lower shell section 15. The upper ends of the mounting springs support mounting lugs 25 (one of which is illustrated) extending from the motor-compressor assembly 10.

The motor-compressor assembly 10 includes a lower frame 30 and an upper frame 31 joined to each other at a tongue and flange type joint 32. Attached to the lower frame 30 by screws 33 is an annular stator core 40 of the electric motor 12. Wound around the stator core 40 in a conventional manner is a stator winding having an upper coil section 41 and a lower coil section 42. The lower coil section 42 of the stator winding is submerged in the body of lubricating oil 20 to aid in the cooling of the electric motor 12.

A motor rotor 45 is centered within the stator core 40 and movable in relation thereto. The lower portion 46 of the rotor 45 is spaced a distance above the body of oil 20 within the sump area 21 of the shell 11.

The rotor 45 includes a shaft 47 having a longitudinal axis a—a' of rotation. The lower end of the shaft 47 is rotationally supported by a journal and thrust bearing 48 provided by a spider frame 49 extending from the lower frame 30. The upper end of the shaft 47 is journaled within an upper bearing 50 supported by and fixed to the upper frame 31.

The upper end of the shaft 10 constitutes a crank shaft 55 for the compressor 13. The compressor 13 includes a compression cylinder sleeve 56 pressed into and received by a portion 57 of the upper frame 31. A compression piston 58 reciprocates in relation to the compression cylinder sleeve 56 in a conventional manner and is connected to a crank arm 60 protruding from the crank shaft 55 by a connecting rod 59. A free end 61 of the connecting rod 59 is connected to the crank arm 60. The motor shaft 47 also includes a counter weight 65 diametrically opposed to the crank arm 60 which is disposed eccentrically with respect to the longitudinal axis a—a' of the motor shaft. The configuration and operation of the motor-compressor assembly as disclosed heretofore is well known in the art.

Attached to the lower portion of the motor shaft 47, between the journal and thrust bearing 48 and the rotor 45, is an oil stirrer in accordance with the present invention for churning and aerating the body of lubricating oil 20 with the refrigerant gas contained within the shell 11. The stirrer 70 comprises an open ended truncated cone having a minimum diameter end or apex portion 71 and a maximum diameter end or base portion 72. As illustrated in FIG. 1, the truncated cone is formed of thin perforated sheet metal constituting a surface of regularly spaced apertures. The apex portion 71 of the truncated cone is fixed in relation to the shaft 47 by means of a press fitted ringlike flange 75 (shown more clearly in FIG. 2) while the base portion 72 of the truncated cone is submerged in the body of lubricating oil 20.

The base portion 72 of the truncated cone constitutes an apertured surface of revolution having its axis coincident with the longitudinal axis a—a' of a motor shaft 47. Each of the apertures has a center axis normal to its planar area, the center axis extending in a generally radial direction from the longitudinal axis of rotation a—a'. The base portion 72 of the truncated cone circumferentially extends about the longitudinal axis a—a' of the motor shaft 47 and occupies a generally annular area in the body of lubricating oil 20.

FIG. 2 illustrates an alternative embodiment of the oil stirrer in accordance with the present invention wherein the truncated cone portion of the stirrer is formed of foil-like expanded grid material (schematically illustrated). As illustrated in FIG. 1, the perforated sheet metal forming the apex portion of the truncated cone is fixed to the shaft 47 by the ringlike flange 75 which is press fitted onto the shaft 75. The ringlike flange 75, shown more clearly in FIG. 2, defines a circular L-shaped groove 76 which is adapted to receive and retain an upper-edge 77 of the apex portion 71 of the truncated cone.

FIG. 3 illustrates in perspective view a portion 74 of the expanded metal grid material schematically illustrated in FIG. 2. Apertures 80 are defined by thin foil-like walls 81 which are pitched or non-parallel in relation to the direction of movement (illustred by arrow 78) of the portion 74 through the body of lubricating oil 20 when the stirrer is rotating. Such pitched walls cause increased turbulence of the body of oil 20 thereby enhancing aeration of the oil.

Another alternative embodiment of an oil stirrer in accordance with the invention utilizing thin, perforated sheet metal is illustrated in FIG. 4. In this embodiment of the invention, the ringlike flange 75 has been deleted, and the apex portion of the truncated cone has an upper mounting edge 85 with a downwardly projecting annular flange portion 86. The flange is press fitted onto the shaft 47. The perforated sheet metal illustrated in FIG. 4 is identical to that illustrated in FIG. 1 and contains regular spaced apertures 87, preferably in the forms of circular holes having a diameter of approximately 0.05 inches, with their centers spaced approximately 0.075 inches from each other.

Another alternative embodiment of the invention is illustrated in FIG. 5 wherein the truncated cone portion of the oil stirrer is formed of screen mesh material 90, and is attached to the shaft 47 by means of the retainer ring 75 as earlier described.

It has been found that an apertured oil stirrer in accordance with the present invention as illustrated in FIGS. 1 through 4 provides, at reduced noise levels, aeration of the body of lubricating oil with refrigerant gas thereby reducing its sound transmission qualities.

Although, preferred embodiments of this invention are illustrated, it is to be understood that various modifications and rearrangements of parts may be resorted to without departing from the scope of the invention disclosed and claimed herein.

What is claimed is:

1. A refrigeration apparatus comprising:
a shell containing a gas;
a motor compressor assembly mounted within said shell, said motor-compressor assembly having a rotatable shaft with a longitudinal axis of rotation;
a body of oil contained within said shell; and
an oil stirrer for aerating said body of oil with said gas, said stirrer being fixed to said shaft, said oil stirrer having a portion formed of thin sheet material having a large plurality of closely spaced apertures said material being shaped into an open-ended truncated cone with an apex portion and a base portion, said apex portion being fixed to said shaft and being above said body of oil, said base portion extending into and immersed in said body of oil.

2. An apparatus according to claim 1 wherein said cone has an axis of rotation coincident with said longitudinal axis of rotation.

3. An apparatus according to claim 1 wherein said apex portion is fixed to said shaft by a ringlike flange press fitted onto said shaft.

4. An apparatus according to claim 1 wherein said apertured sheet material is perforated sheet metal.

5. An apparatus according to claim 1 wherein said apertured sheet material is screen mesh.

6. An apparatus according to claim 1 wherein said apertured sheet material is a foil-like expanded metal grid.

7. A refrigeration apparatus comprising:
a shell containing a gas;
a motor-compressor assembly mounted within said shell, said motor-compressor assembly having a rotatable shaft with a longitudinal axis of rotation;
a body of oil contained within said shell;
an oil stirrer for aerating said body of oil with said gas, said oil stirrer being fixed to said shaft, said oil stirrer being formed of perforated sheet metal having a plurality of regularly spaced perforations, said sheet metal being shaped into a truncated cone having an open-ended apex portion with an upper edge fixed in relation to said shaft and an open-ended base portion being submerged in said body of oil, said truncated cone having an axis of rotation coincident with said longitudinal axis of rotation; and
a ringlike flange press fitted onto said shaft, said flange defining a groove adapted to receive and retain said upper edge.

* * * * *